US007876045B2

(12) United States Patent
Park

(10) Patent No.: US 7,876,045 B2
(45) Date of Patent: Jan. 25, 2011

(54) PLASMA DISPLAY PANEL HAVING BARRIER RIBS WITH PIGMENTS WITH DIFFERENT MIXING RATIOS

(75) Inventor: Dae Hyun Park, Yongin-si (KR)

(73) Assignee: LG Electronics Inc., Seoul (KR)

( * ) Notice: Subject to any disclaimer, the term of this patent is extended or adjusted under 35 U.S.C. 154(b) by 348 days.

(21) Appl. No.: 12/101,537

(22) Filed: Apr. 11, 2008

(65) Prior Publication Data

US 2008/0265773 A1 Oct. 30, 2008

(30) Foreign Application Priority Data

Apr. 24, 2007 (KR) ..... 10-2007-0039765

(51) Int. Cl.
*H01J 17/49* (2006.01)

(52) U.S. Cl. ..... 313/582; 313/584; 313/585; 313/586; 313/587

(58) Field of Classification Search ..... 313/582–585
See application file for complete search history.

(56) References Cited

U.S. PATENT DOCUMENTS

| | | | | |
|---|---|---|---|---|
| 5,635,006 | A * | 6/1997 | Watanabe et al. | 156/240 |
| 5,786,042 | A * | 7/1998 | Inoue et al. | 428/1.3 |
| 5,909,083 | A * | 6/1999 | Asano et al. | 313/584 |
| 6,008,582 | A * | 12/1999 | Asano et al. | 313/582 |
| 2005/0040767 | A1 * | 2/2005 | Yoo et al. | 313/587 |
| 2007/0001602 | A1 * | 1/2007 | Miyake et al. | 313/582 |
| 2007/0241681 | A1 * | 10/2007 | Yoo et al. | 313/582 |

* cited by examiner

*Primary Examiner*—Sikha Roy
(74) *Attorney, Agent, or Firm*—KED & Associates, LLP

(57) ABSTRACT

A plasma display panel and a method for manufacturing the same is disclosed. The plasma display panel includes a first substrate including a first electrode; a second substrate arranged to face the first substrate, the second substrate including a second electrode; and barrier ribs arranged between the first substrate and the second substrate to define a discharge cell, the barrier ribs being colored with at least two different pigments in mixtures.

20 Claims, 11 Drawing Sheets

PLASMA DISPLAY PANEL HAVING BARRIER RIBS WITH PIGMENTS WITH DIFFERENT MIXING RATIOS

This application claims the benefit of Korean Patent Application No. 10-2007-0039765, filed on Apr. 24, 2007, which is hereby incorporated by reference as if fully set forth herein.

BACKGROUND OF THE INVENTION

1. Field of the Invention

The present invention relates to a plasma display panel, and more particularly, to a plasma display panel capable of reducing a reflection of external light and improving ambient contrast by coloration of barrier ribs, and to a method for manufacturing the same.

2. Discussion of the Related Art

In accordance with the advent of an age of multimedia, development of a display device capable of more finely rendering colors more approximate to natural colors while having a larger size is being required.

However, the current cathode ray tubes (CRTs) have a limitation in realizing a large screen of 40 inches or more. For this reason, liquid crystal displays (LCDs), plasma display panels (PDPs), and projection televisions (TVs) are being rapidly developed so that the applications thereof can be extended to a high-quality image field.

The plasma display panel is an electronic device which uses a plasma discharge to display images. When a predetermined voltage is applied to electrodes arranged in a discharging space of the PDP, the plasma discharge is occurred between the electrodes. Vacuum ultra violet (VUV) generated during this plasma discharge excites phosphor layers formed in a predetermined pattern to thereby form an image.

In general, the PDP comprises an upper substrate sequentially provided with a plurality of sustaining electrode pairs, an upper dielectric and a passivation film, and a lower substrate sequentially provided with address electrodes, a lower dielectric and barrier ribs.

The barrier ribs are arranged to define each discharge cell, and inside each discharge cell, the phosphor layer is formed.

The PDP constituting as in the above increases reflection of the panel itself by the external light incident to the PDP through the entire visible area of the panel resulting in reducing the ambient contrast.

SUMMARY OF THE INVENTION

Accordingly, the present invention is directed to a plasma display panel and a method for manufacturing the same that substantially obviate one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma display panel comprises: a first substrate including a first electrode; a second substrate arranged to face the first substrate, the second substrate including a second electrode; and barrier ribs arranged between the first substrate and the second substrate to define a discharge cell, the barrier ribs being colored with at least two different pigments in mixtures.

Here, at least two different pigments may be in a complementary relation, and the colored barrier ribs may be colored into chromatic color.

Each pigment may be contained in an amount of 0.1 to 10 parts by weight based on the composition of the barrier ribs. The barrier ribs may contain a mixture of a cobalt blue pigment and a brown pigment.

Further, the pigments contained in each barrier rib may be mixed with the same mixing ratio for the entire barrier ribs. The pigments contained in each barrier rib may be mixed with different mixing ratios depending on a position of the barrier rib.

In another aspect of the present invention, a method for manufacturing a plasma display panel comprises: preparing a first substrate including a first electrode and a second substrate including a second electrode; forming a barrier rib paste containing at least two pigments to form a discharge cell on the second substrate; drying and curing the barrier rib paste to form colored barrier ribs; forming a phosphor layer in the discharge cell; and assembling the first substrate and the second substrate.

The barrier rib paste may be dried in a temperature ranging 50 to 250° C., and the drying may be performed for 5 to 90 minutes. The dried paste may be cured in a temperature ranging 300 to 600° C., and the curing may be performed for 30 to 60 minutes.

Each pigment contained in the barrier rib paste may be contained in an amount of 0.1 to 10 parts by weight based on the total barrier rib composition. The phosphor layer may contain 65 to 99.99 parts by weight of a phosphor powder and 0.01 to 35 parts by weight of a pigment.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
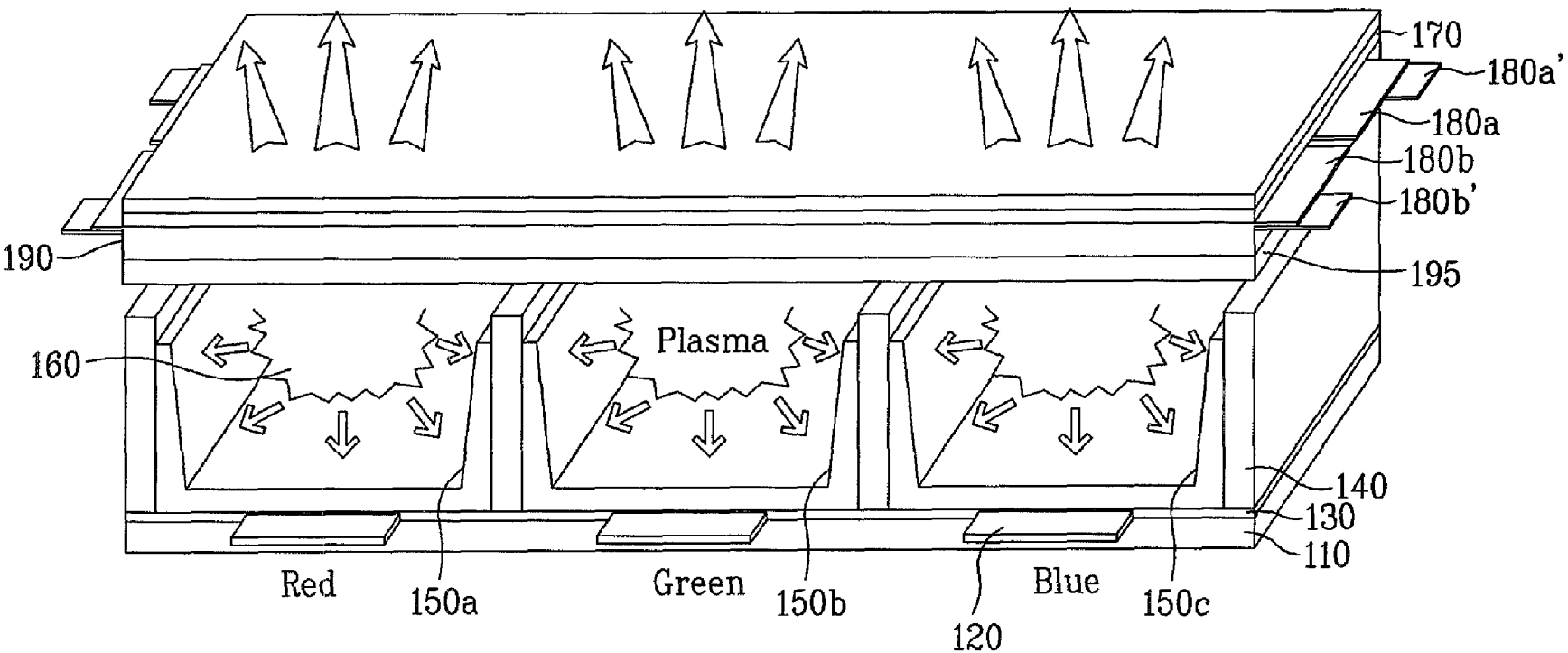
FIG. 1 is a view illustrating a plasma display panel according to the present invention.

Reference will now be made in detail to the preferred embodiments of the present invention, examples of which are illustrated in the accompanying drawings.

This invention may, however, be embodied in many alternate forms and should not be construed as limited to the embodiments set forth herein. Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims.

FIG. 1 is a view illustrating a plasma display panel according to the present invention. As shown in FIG. 1, the plasma display panel of the present invention includes transparent electrodes 180*a* and 180*b* and bus electrodes 180*a*' and 180*b*' formed in pairs on the front substrate 170 while extending in one direction, to constitute sustain electrode pairs.

The plasma display panel also includes a dielectric layer 190 and a passivation film 195 sequentially formed, in this order, over the overall surface of the front substrate 170 provided with the sustaining electrode pairs.

Here, the front substrate 170 is prepared by machining a glass for a display substrate, using milling and cleaning.

The transparent electrodes 180*a* and 180*a*, made of ITO (Indium-Tin-Oxide) or $SnO_2$, are formed in accordance with a photo-etching method using a sputtering process or a lift-off method using a CVD process.

The bus electrodes 180*a*' and 180*b*' are made of widely used conductive metals and precious metals.

Examples of the widely used conductive metals include aluminum (Al), copper (Cu), nickel (Ni), chromium (Cr), molybdenum (Mo), or the like. Examples of the precious metals include silver (Ag), gold (Au), platinum (Pt), iridium (Ir), or the like.

Thereafter, when combining the commonly used metal with the precious metal, the commonly used metal may form a core and the precious metal may cover the surface of the core.

The dielectric layer 190 is formed over the front substrate 170 provided with the transparent electrodes 180*a* and 180*b* and bus electrodes 180*a*' and 180*b*'. The dielectric layer 190 is made of a transparent glass having a low melting point.

The passivation film 195 is formed over the dielectric layer 190, using a magnesium oxide. The passivation film 195 functions to protect the upper dielectric layer 190 from an impact of positive (+) ions during an electrical discharge, while functioning to increase the emission of secondary electrons.

Address electrodes 120 are formed on one surface of the back substrate 110 such that they extend in a direction perpendicular to the extension direction of the sustaining electrode pair. A white dielectric layer 130 is also formed over the overall surface of the back substrate 110, to cover the address electrodes 120.

Here, the address electrodes 120 may be made of commonly used conductive metals and precious metals as the above-described bus electrodes. Examples of the commonly used conductive metals include aluminum (Al), copper (Cu), nickel (Ni), chromium (Cr), molybdenum (Mo), or the like. Examples of the precious metals include silver (Ag), gold (Au), platinum (Pt), iridium (Ir), or the like.

The formation of the white dielectric layer 130 is achieved by laminating a layer over the back substrate 110 in accordance with a printing method or a film laminating method, and curing the laminated layer.

Then, barrier ribs 140 are formed on the white dielectric layer 130.

Here, the barrier ribs 140 are colored into achromatic color by mixing at least two different pigments.

It is preferred that the two or more different pigments are complementary to each other.

Each pigment contained in the barrier ribs are preferably contained in an amount of about 0.1 to 10 parts by weight based on the composition of the barrier ribs 140.

The reason for combining at least two different pigments having a complementary relation to each other to contain in the barrier ribs of the present invention is as in the following.

If the barrier ribs are colored into black color, ambient contrast may be enhanced. However, the visible light absorption is occurred inside the discharge cell resulting in brightness loss of the plasma display panel.

Therefore, when the barrier ribs are colored into achromatic color such as gray as in the present invention, the brightness loss can be prevented, in addition to enhancing the ambient contrast.

That is, when different pigments having a different reflectance curve from each other are combined in an appropriate ratio, the surface color of the barrier ribs are maintained to have an achromatic gray tone.

Therefore, depending on the mixing ratio of the different pigments the light reflectance can be controlled, because the pigments contained in the barrier ribs can reduce the light reflectance at a specific wavelength band.

For example, the different pigments contained in the barrier ribs may be contained in the overall barrier ribs with the same mixing ratio. The different pigments may be contained in each barrier ribs with different mixing ratios depending on the position of the barrier rib.

As can be seen, the two or more different pigments contained in the barrier ribs can have different light reflectance from each other. Thus, the colored barrier ribs can reduce light reflectance at a specific wavelength band.

As an exemplary embodiment of the present invention, a pigment mixture of cobalt blue and brown are contained in the barrier ribs.

In this case, the colored barrier ribs can reduce light reflectance at the wavelength band of red colors.

Figure 2A:
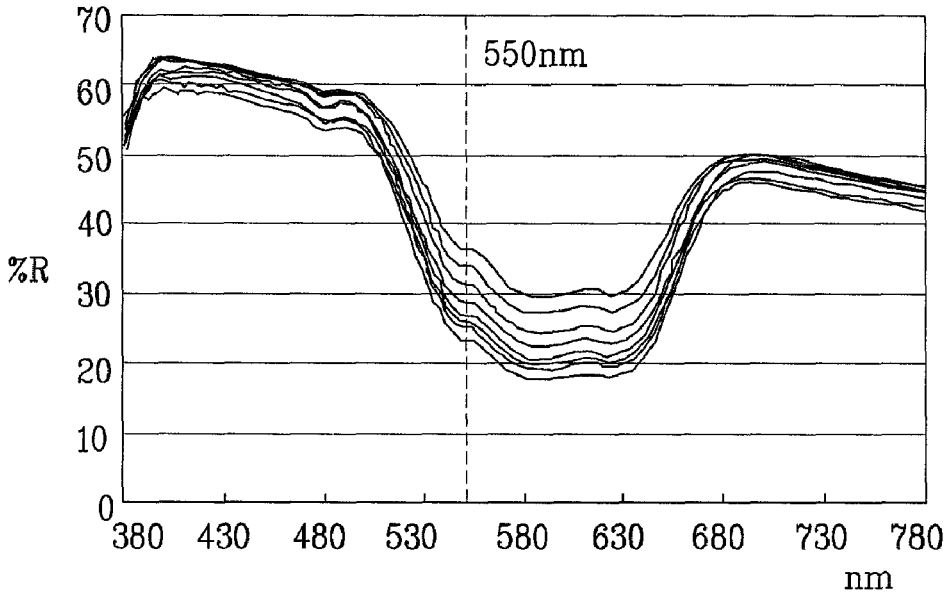
FIGS. 2A and 2B are graphs each illustrating the reflectance of pigments contained in barrier ribs of the present invention.
Figure 2B:
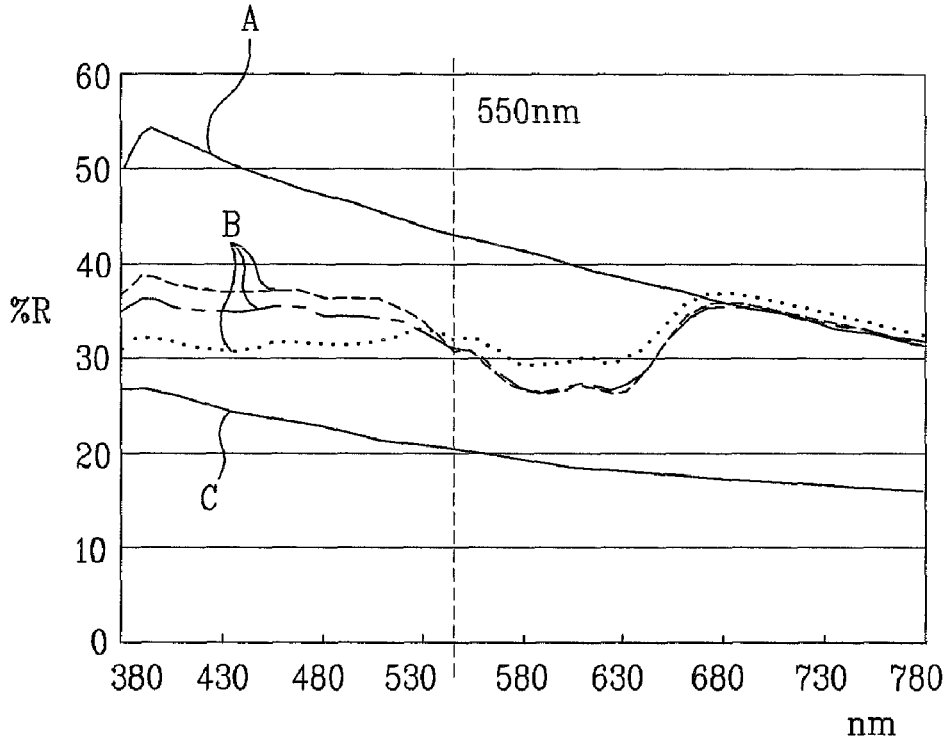

FIGS. 2A and 2B are graphs each illustrating the reflectance of pigments contained in barrier ribs of the present invention.

FIG. 2A shows the reflectance curve of a cobalt blue pigment. The curve shows reduced reflectance with respect to external light at a wavelength band of visible light band, which is 450 to 650 nm.

FIG. 2B is a graph comparing the reflectance curves of an ideal pigment A, a pigment mixture B having different pigments combined therein, and a single pigment C. As can be seen in the present invention, the reflectance curve of the pigment mixture B of cobalt blue and brown, when compared with the ideal pigment A, shows reduced reflectance curve only at a wavelengths band of about 550 nm, while showing similar reflectance curve with the ideal pigment A at other wavelength bands.

Therefore, when the barrier ribs are colored with different pigments in an appropriate mixing ratio, there is a large improvement in the color purity and color coordinate, in addition to enhancement in the ambient contrast of the plasma display panel.

In the case of combining the cobalt blue pigment and the brown pigment, a color in the achromatic gray tone can be obtained.

At this time, the obtained color, seen with bare eyes, has approximately the similar color as the gray obtained when using a black pigment.

When using a black pigment, the reflectance curve is generated throughout the overall wavelengths. However, it was confirmed that the reflectance did not reduce greatly at the wavelengths of blue and brown when the pigment mixture of cobalt blue and brown was used, while the reflectance reduced greatly at the wavelengths of green and yellow.

The coloration of the barrier ribs by combining different pigments having the above effect can result in preventing absorption of the visible light emitted inside the discharge cell, as well as reducing reflectance with respect to external light. Thus, an effect of largely reducing the brightness loss can be obtained.

Meanwhile, the reflectance curve of a single pigment C shows that the reflectance with respect to external light can be reduced. However, the color brightness is also reduced, thereby degrading the ambient contrast.

The barrier ribs 140 may be of a stripe type, a well type, or a delta type.

The barrier ribs 140 each comprise a parent glass and a porous filler. As the mother glass, a leaded mother glass and an unleaded mother glass are mentioned. The leaded mother glass includes ZnO, PbO and $B_2O_3$, and the unleaded mother glass includes ZnO, $B_2O_3$, BaO, SrO and CaO.

Moreover, oxides such as $SiO_2$, $Al_2O_3$ or the like may be included as the filler.

Red (R), green (G), and blue (B) phosphor layers 150*a*, 150*b*, and 150*c* are formed between the adjacent barrier ribs 140.

Here, the phosphor layers 150*a*, 150*b*, and 150*c* can be prepared by mixing a vehicle to phosphor powders, forming phosphor pastes, and then drying and curing the paste.

As the phosphor powders, a blue phosphor material, a green phosphor material, and a red phosphor material can all be used.

For example, a phosphor material selected from the group consisting of red phosphors, such as $Y(V,P)O_4$:Eu. (Y,Gd) $BO_3$:Eu, and like phosphors, green phosphors, such as $Zn2SiO_4$:Mn, (Zn,A)2$SiO_4$:Mn (where A is an alkaline metal), and combinations thereof, can be used.

Moreover, a green phosphor material in combination with at least a phosphor material selected from a group consisting of (Ba,Sr,Mg)O.aAl2$O_3$:Mn (where a is an integer of 1 to 23), $MgAlxO_y$:Mn (where x is an integer of 1 to 10, and y is an integer of 1 to 30), $LaMgAlxO_y$:Tb (where x is an integer of 1 to 14, and y is an integer of 8 to 47), and $ReBO_3$:Tb (where Re is at least a rare earth element selected from Sc, Y, La, Ce, and Gd) can also be used.

As the blue phosphor material, $BaMgAl_{10}O_{17}$:Eu, $CaMgSi_2O_6$:Eu, $CaWO_4$:Pb, $Y_2SiO_5$:Eu, or combinations thereof can be used.

As the vehicle, a mixture of about 5 to 80% by weight of an organic binder and about 10 to 95% by weight of a solvent can be used.

At this time, the organic binder is an organic polymer including cellulose-based polymers, acryl-based polymers, vinyl-based polymers, or the like.

The cellulose-based polymers that can be used in the present invention include methyl, ethyl, nitrocellulose, or the like. The acryl-based polymers include polymethylmethacrylate, polymethylacrylate, polyethylacrylate, polyethylmethacrylate, polynormalpropylacrylate, polynormalpropylmethacrylate, polyisopropylacrylate, polyisoporpylmethacrylate, polynormalbutylacrylate, polynormalbutylmethacrylate, polycyclohexylacrylate, polycyclohexylmethacrylate, polylaurylacrylate, polylaurylmethacrylate, polystearylacrylate, polystearylmethacrylate, or the like. These polymer monomers can be used in a copolymerized form of two or more.

Furthermore, the vinyl-based polymers include polyethylene, polypropylene, polystyrene, polyvinylalcohol, polybutylacetate, polyvinylpyrrolidone, or the like.

These polymers can be used alone, but if necessary, they can be used in combinations.

As the solvent, any one capable of dissolving organic polymers, such as cellulose-based polymers, acryl-based polymers, vinyl-based polymers, or the like, can be used.

Examples of the solvent include organic solvents such as benzenes, alcohols, chloroform, esters, cyclohexanone, N,N-dimethylacetamide, or acetonitrile, or aqueous solvents such as water, an aqueous potassium sulfate solution, or an aqueous magnesium sulfate solution. The solvent can be used alone or in combination of two or more selected from the above-mentioned solvents.

If necessary, the phosphor paste may further include additives such as an acryl-based dispersant for improving flow characteristic, a silicone-based antifoaming agent, a leveling agent, an antioxidant, a plasticizer such as dioctylphthalate, and the like.

It is preferred that the additives are contained in an amount of about 0.1 to 5% by weight based on the total weight of the phosphor composition.

This is because, when the content of the additives exceeds about 0.1 to 5% by weight based on the total weight of the phosphor composition, the printability can be degraded.

Meanwhile, the phosphor layers 150*a*, 150*b*, and 150*c* may further include a pigment.

The reason for including the pigment is to enhance the ambient contrast through reducing the reflectance of incident light. Additionally, the pigment itself functions to serve as a color filter, thereby improving the color purity and the color coordinate.

Preferably, each phosphor layer comprises a pigment about 65 to 99.99 parts by weight of a phosphor powder and about 0.01 to 35 parts by weight of a pigment.

Here, the pigment contained in the phosphor layers may be an iron oxide pigment, a cobalt green pigment, an emerald green pigment, a chromium oxide green pigment, a chromium-alumina green pigment, a Victoria green pigment, a cobalt blue pigment, a Prussian pigment, a Turkey blue pigment, Co—Zn—Si pigment, and the like.

The pigment contained in the phosphor layers may be selected from $\alpha$-$Fe_2O_3$ (Co,Zn)O.$(Al,Cr)_2O_3$, 3CaO—$Cr_2O_3$.3$SiO_2$, $(Al,Cr)_2O_3$, $CoOAl_2O_3$, 2(Co,Zn)O.$SiO_2$, $ZrSiO_4$, and the like.

The phosphor layers 150*a*, 150*b*, and 150*c* are dried at a temperature ranging about 50 to 250° C. for about 5 to 90 minutes. The dried phosphor layers 150*a*, 150*b*, and 150*c* are cured at a temperature ranging 300 to 600° C. for about 30 to 60 minutes, under vacuum or inert gas atmosphere.

It is most preferable that the curing is performed at a low temperature of about 400 to 550° C. for about 30 to 60 minutes.

After forming the phosphor layers 150*a*, 150*b*, and 150*c*, the front substrate 170 and the back substrate 110 are assembled such that the barrier ribs 140 are interposed between the front and back substrates. The cohesion is completed using a sealing material provided on the outer substrate.

Then, the upper panel and the lower panel are connected with a driving device.

Figure 3:
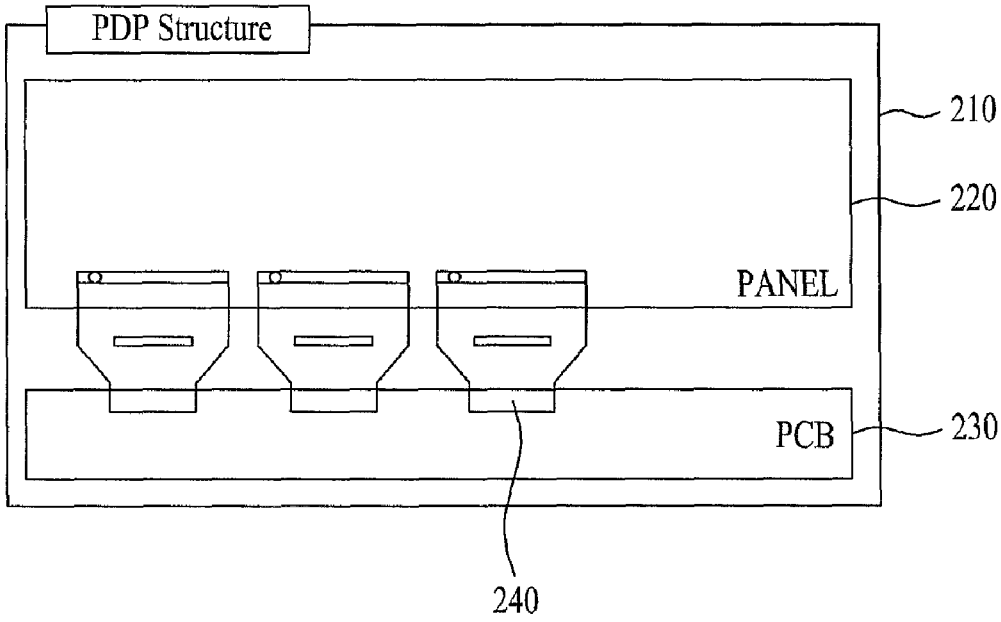
FIG. 3 is a view illustrating a driving device and a connecting member of a plasma display panel according to the present invention.

FIG. 3 is a view illustrating a driving device and a connecting member of a plasma display panel according to the present invention.

As shown in FIG. 3, the overall plasma display device comprises a panel 220, a driving substrate 230 for providing a driving voltage to the panel 220, and a tape carrier package (hereinafter, abbreviated as TCP) 240, which is a flexible substrate, for connecting the driving substrate 230 with electrodes on each cell of the panel 220.

The panel 220, as mentioned above, comprises a front substrate, a back substrate, and barrier ribs.

The electrical and physical connection of the panel 220 with the TCP 240, and the TCP 240 with the driving substrate 230 is achieved using an anisotropic conductive film (hereinafter, abbreviated as ACF). The ACF is a conductive resin film made using a nickel (Ni) ball coated with gold (Au).

Figure 4:
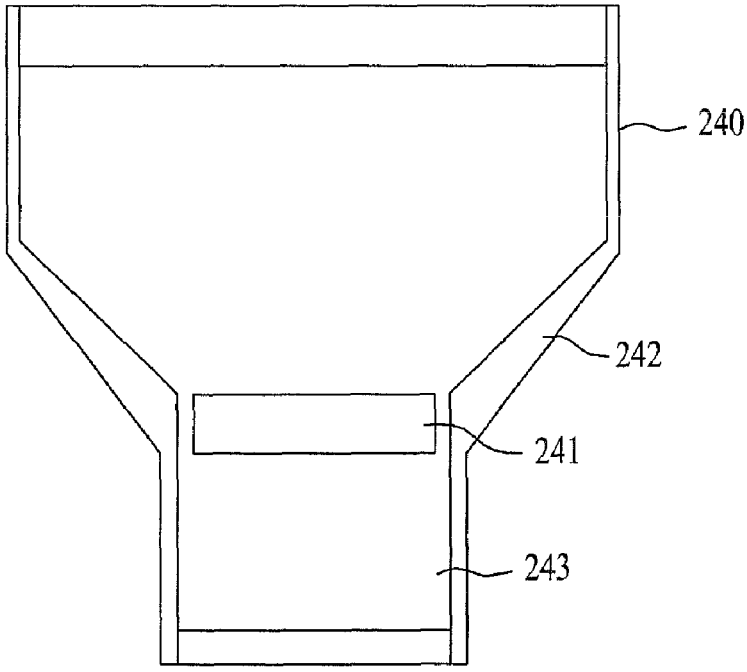
FIG. 4 is a view illustrating substrate wiring structure of a tape carrier package.

FIG. 4 is a view illustrating substrate wiring structure of a tape carrier package.

As shown in FIG. 4, the TCP 240 serves as a wiring between the panel 220 and the driving substrate 230, and a driver chip is mounted on the TCP 240. The TCP 240 comprises wirings 243 tightly arranged on a flexible substrate 242, and a driver chip 241 connected with the wirings 243 for receiving power from the driving substrate 230 and providing the power to a specific electrode of the panel 220.

The driver chip 241 has a structure in that it receives small number of voltages and control signals, and outputs high power and many signals by alternating them. Thus, the number of wirings connected with the driving substrate 230 is less than that connected with the panel 220.

There may be a case where wirings of the driver chip 241 are connected using the space at the driving substrate 230 side. In this case, the wirings 243 may not be divided at the middle of the driver chip 241.

Figure 5:
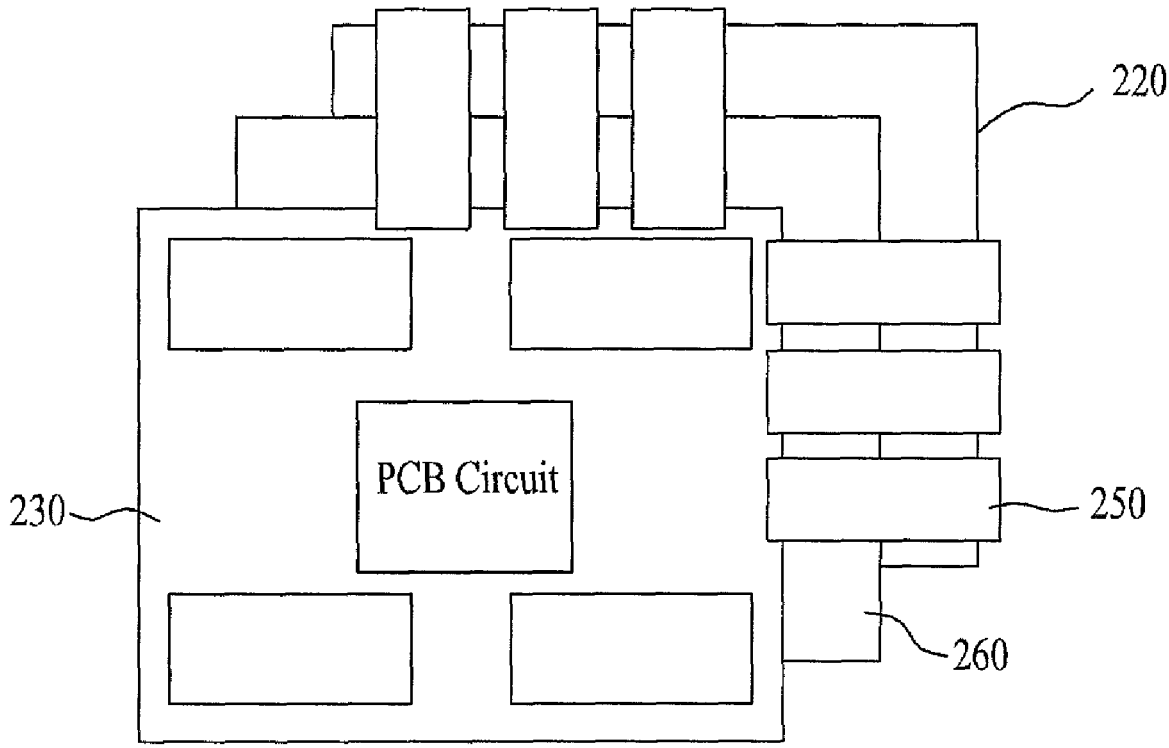
FIG. 5 is a perspective view illustrating another exemplary embodiment of FIG. 4.

FIG. 5 is a perspective view illustrating another exemplary embodiment of FIG. 4.

In this embodiment, the panel 220 is connected with the driving device through a flexible printed circuit (hereinafter, abbreviated as FPC) 250.

The FPC 250 is a film having a pattern formed therein using polymide. In this embodiment, FPC 250 is connected with the panel 220 through ACF.

Moreover, it is natural that the driving substrate 230 is a PCB circuit.

Here, the driving device comprises a data driver, a scan driver, and a sustain driver. The data driver is connected with address electrodes and applies data pulse. The scan driver is connected with scan electrodes and provides ramp-up and ramp-down waveforms, scan pulse, and sustain pulse.

Further, the sustain driver applies sustain pulse and DC voltage to common sustain electrodes.

The plasma display panel is driven according to the reset period, address period, and sustaining period.

During the reset period, the ramp-up waveforms are applied to the scan electrodes at the same time. During the address period, negative scan pulse is applied the scan electrodes sequentially. At the same time, positive data pulse synchronized with the scan pulse is applied to the address electrodes.

Further, during the sustaining period, the sustain pulse (sus) is applied to the scan electrodes and sustain electrodes, alternately.

FIGS. 6A to 6K are views illustrating a method for manufacturing a plasma display panel according to an exemplary embodiment of the present invention.

Hereinafter, an embodiment of a method for manufacturing a plasma display panel in accordance with the present invention will be described with reference to FIGS. 6A to 6K.

Figure 6A:
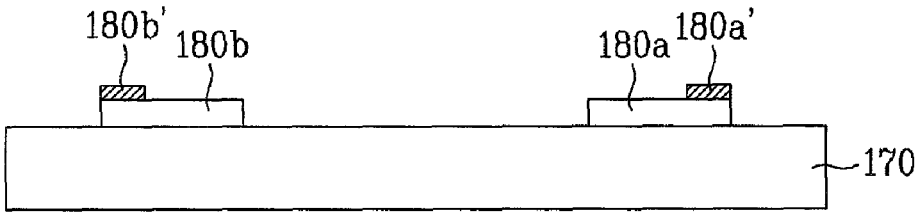
FIGS. 6A to 6K are views illustrating a method for manufacturing a plasma display panel according to an exemplary embodiment of the present invention.

First, as shown in FIG. 6A, transparent electrodes 180*a* and 180*b* and bus electrodes 180*a*' and 180*b*' are formed on a front substrate 170.

The front substrate 170 is prepared by milling and cleaning a glass or a sodalime glass for a display substrate.

The transparent electrodes 180*a* and 180*b* are formed, using ITO or SnO2, in accordance with a photo-etching method using a sputtering process or a lift-off method using a CVD process.

Subsequently, the bus electrodes 180*a*' and 180*b*' are formed, using a material including commonly used conductive metals and precious metals.

The bus electrode material is prepared into a paste by combining the above-mentioned commonly used conductive metals and precious metals. The commonly used conductive metal may form a core, and the precious metal may cover the surface of the core.

Figure 6B:
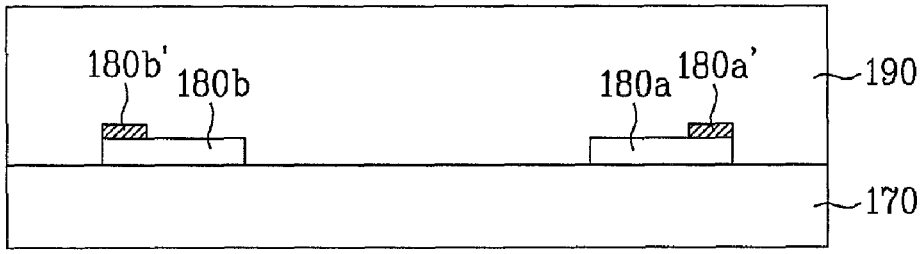

Thereafter, as shown in FIG. 6B, a dielectric 190 is formed over the front substrate 170 provided with the transparent electrodes 180*a* and 180*b* and bus electrodes 180*a*' and 180*b*'.

The formation of the dielectric may be achieved by laminating a material including a low-melting-point glass, etc. in accordance with a screen printing method or a coating method, or laminating a green sheet.

Then, the bus electrode material and the dielectric 190 may be cured. This process can be carried out in separate steps, but to simplify the process, the curing may be carried out in one step.

At this time, it is preferred that the curing is performed at a temperature of about 500 to 600° C. When the bus electrode material and the dielectric are cured together, the amount of the bus electrode material to be oxidized can be reduced since the dielectric intercepts between oxygen and the bus electrodes.

Figure 6C:
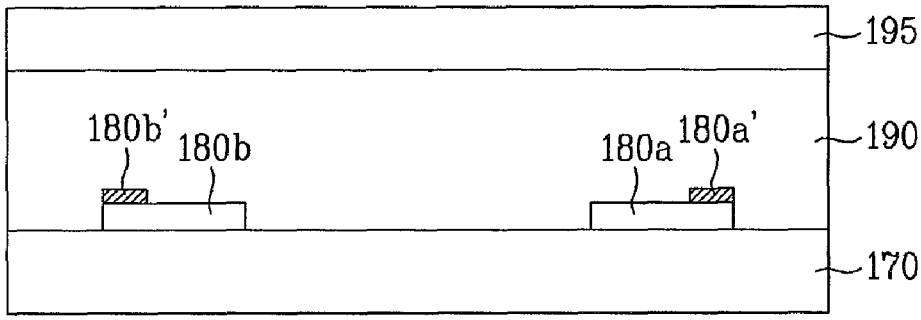

As shown in FIG. 6C, a passivation film 195 is then deposited over the dielectric.

The passivation film 195 is made of magnesium oxide, etc. and may include silicon etc. as a dopant. The formation of the passivation film 195 may be achieved by depositing a magnesium oxide, etc. in accordance with a chemical vapor deposition (CVD) process, an electron beam (E-beam) deposition process, an ion plating process, a sol-gel process, or a sputtering process.

Figure 6D:
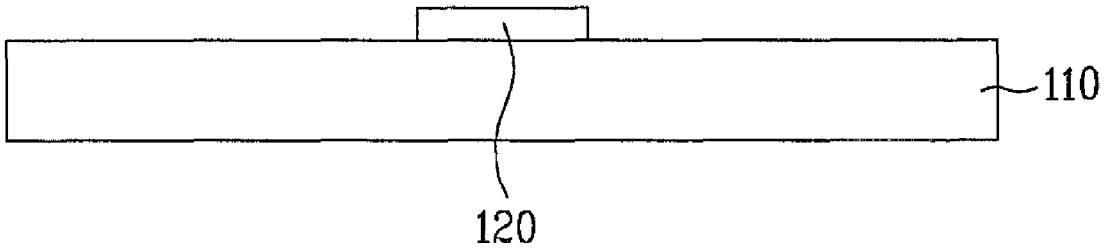

As shown in FIG. 6D, address electrodes 120 are formed on the back substrate 110.

The back substrate 110 is prepared by milling and cleaning a glass or a sodalime glass for a display substrate. The address electrodes 120 are formed, using silver (Ag), in accordance with a screen printing method, a photosensitive paste method, or a photo-etching method. The photo-etching method is carried out after completion of a sputtering process.

The address electrodes 120 may be formed using commonly used conductive metals and precious metals. Specific processes for forming the address electrodes are the same as with the bus electrodes.

Figure 6E:
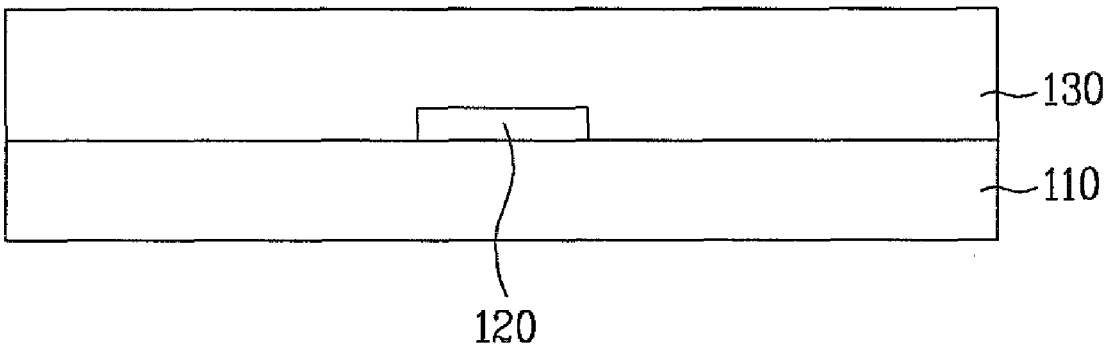

As shown in FIG. 6E, a dielectric 130 is then formed over the back substrate 110 provided with the address electrodes 120.

The formation of the dielectric may be achieved by laminating a material including a low-melting-point glass and a filler such as $TiO_2$ in accordance with a screen printing method or laminating a green sheet. It is preferred that the back-substrate-side dielectric exhibit white, in order to achieve an enhancement in the brightness of the plasma display panel.

To simplify the process, the lower dielectric 130 and the address electrodes 120 may be cured together in one step.

Thereafter, as shown in FIGS. 6F to 6I, barrier ribs are formed to separate discharge cells from one another.

First, at least two pigments and barrier rib composition are mixed to prepare a barrier rib paste.

Each pigment has complementary relation to each other, and can be contained in an amount of 0.1 to 10 parts by weight based on the barrier rib composition.

For example, a pigment mixture of cobalt blue pigments and brown pigments may be contained in the barrier ribs.

At this time, it is preferred that the two or more different pigments to be contained in the barrier ribs have different light reflectance from each other.

Preferably, each pigment contained in the barrier rib paste is contained in an amount of 0.1 to 10 parts by weight based on the total barrier rib composition.

The barrier rib composition comprises about 20 to 60 parts by weight of a low-melting-point glass powder, about 0 to 15 parts by weight of a binder, about 30 to 80 parts by weight of a solvent, and about 0 to 5 parts by weight of a dispersant.

Figure 6F:
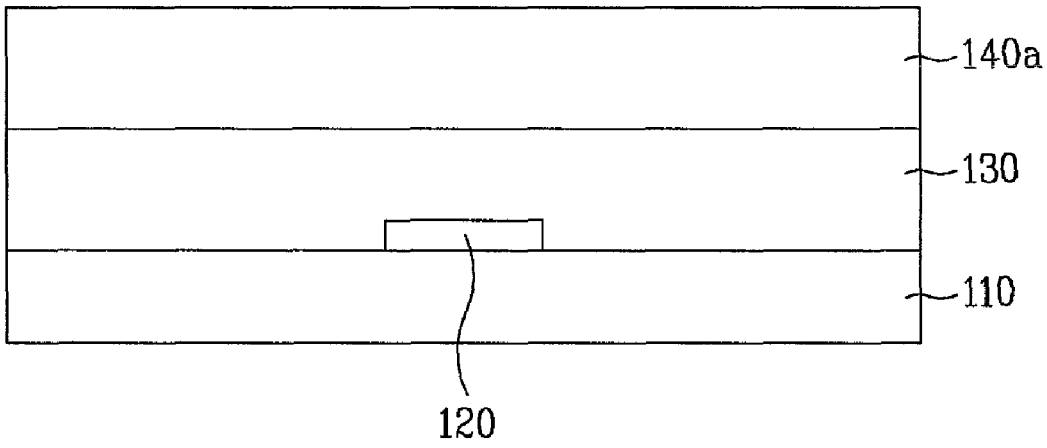

Subsequently, as shown in FIG. 6F, the barrier rib paste 140*a* is coated over the white dielectric 130.

The coating of the barrier rib paste 140*a* may be performed by a spray coating process, a bar coating process, a screen printing process, a green sheet process. Preferably, the barrier rib paste 140*a* may be prepared into a green sheet and laminated.

The patterning of the barrier rib paste 140*a* is achieved by sanding, etching, and photosensitive paste method. Hereinafter, the etching method will be described in detail.

Figure 6G:
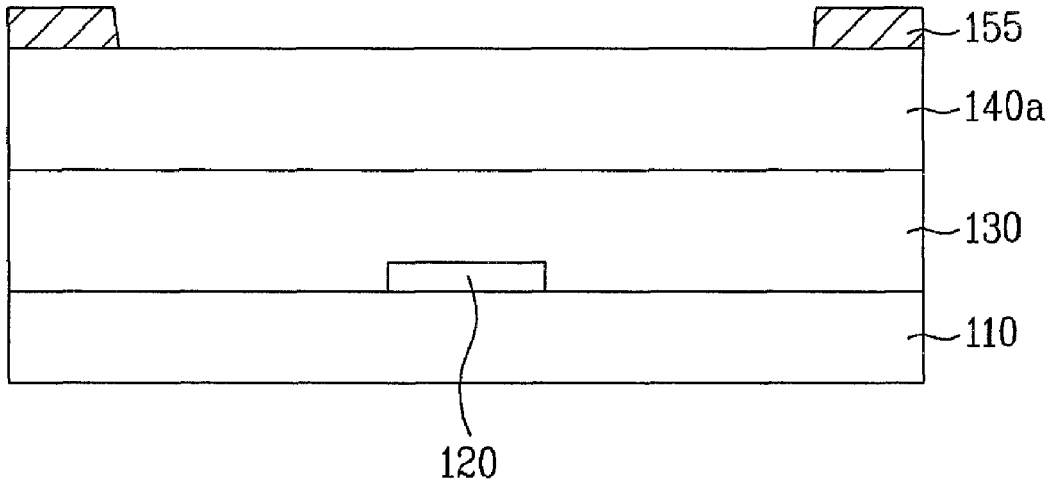

First, as shown in FIG. 6G, dry film resists (DFR) 155 are formed over the barrier rib paste 140*a* with a predetermined space apart from each other.

It is preferred that the DFRs 155 are formed at positions for forming barrier ribs.

Figure 6H:
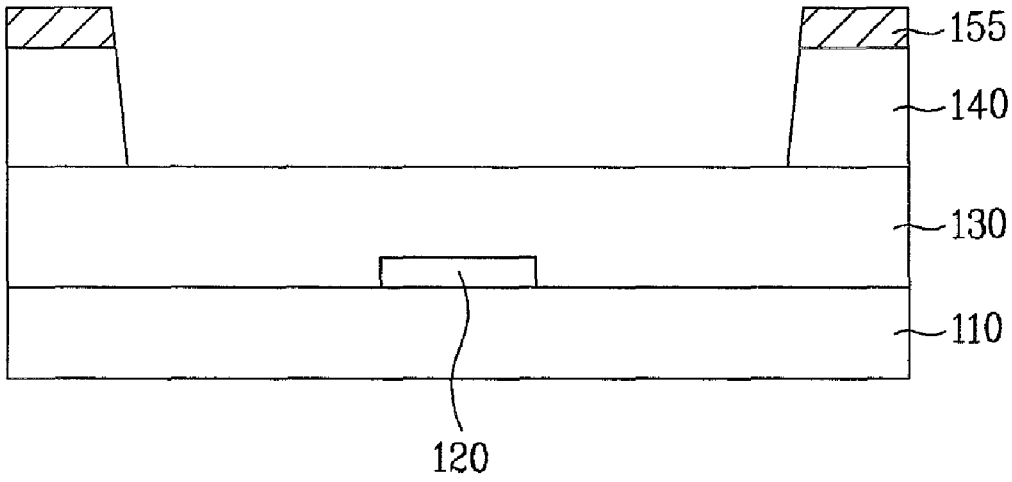

Thereafter, as shown in FIG. 6H, the barrier rib paste is patterned to form barrier ribs 140.

That is, when an etching solution is sprayed from the top of the DFR, the barrier rib material in the regions where the DFRs 155 are not provided is etched gradually, thereby patterning into a barrier rib shape.

Figure 6I:
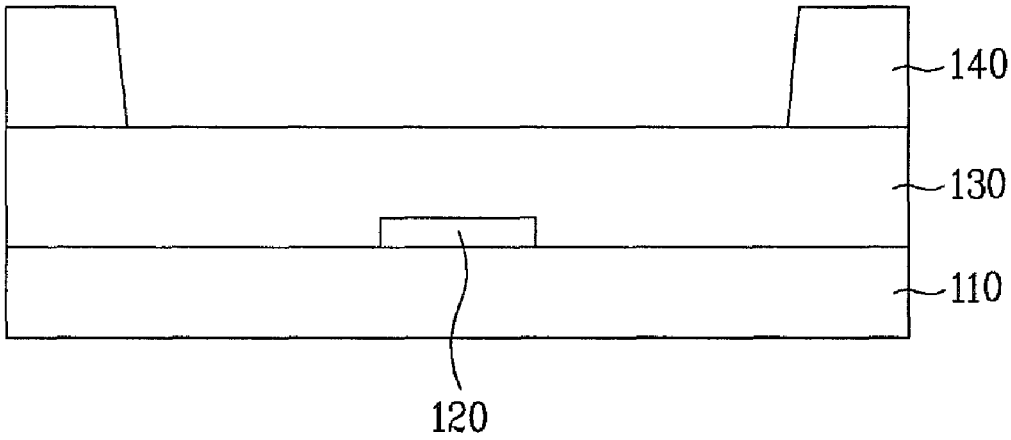

The DFRs 155 are removed. Then, after removing the etching solution through a washing process, curing is performed to complete the barrier rib structure as shown in FIG. 6I.

As mentioned above, the barrier ribs 140 may be of a stripe type, a well type, or a delta type.

Subsequently, the barrier ribs 140 are dried and cured to form colored barrier ribs.

At this time, the drying of the barrier ribs is performed at a temperature ranging about 50 to 250° C. for about 5 to 90 minutes. The curing is performed at a temperature ranging about 300 to 600° C. for about 30 to 60 minutes.

Figure 6J:
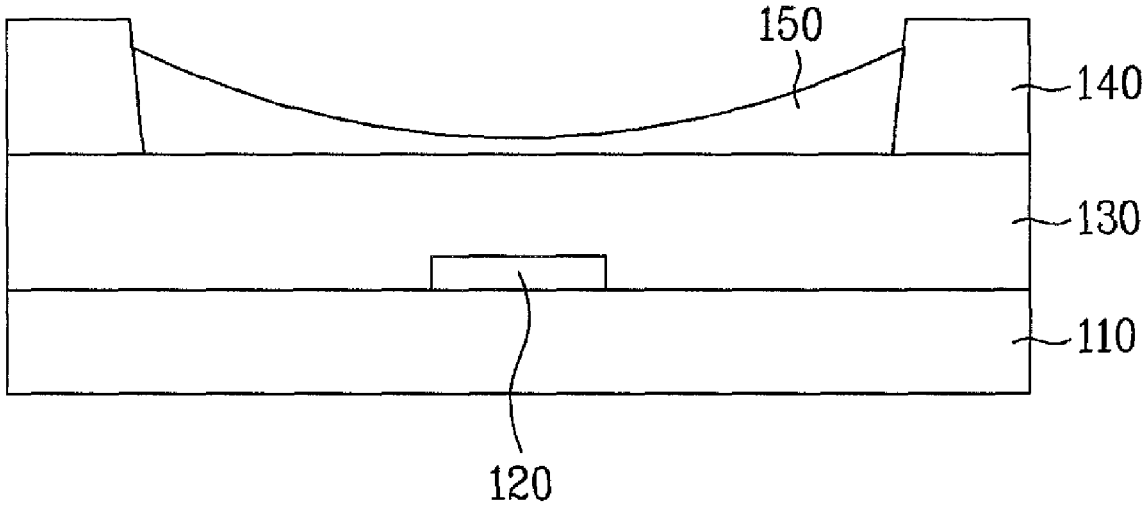

Then, as shown in FIG. 6J, phosphor layers 150*a*, 150*b*, and 150*c* are coated over the surfaces of the white dielectric facing discharge spaces and the side surfaces of the barrier ribs.

The coating of the phosphor layers 150*a*, 150*b*, and 150*c* is carried out such that R, G, and B phosphors are sequentially coated in each discharge cell. The coating is carried out using a screen printing method or a photosensitive paste method.

Figure 6K:
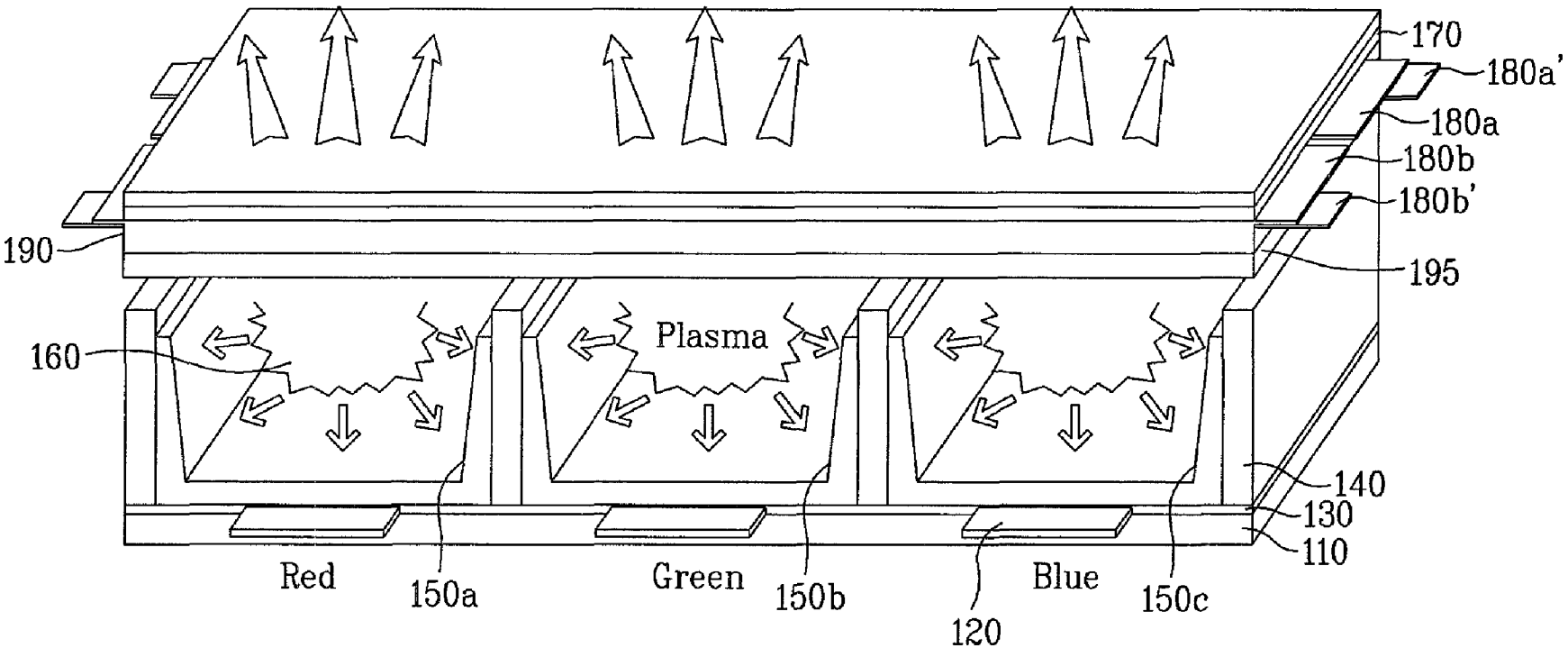

Subsequently, as shown in FIG. 6K, an upper panel is assembled to a lower panel such that the barrier ribs are interposed between the upper and lower panels. The upper and lower panels are then sealed. The space between the upper and lower panels is then evacuated, to remove impurities from the space. Thereafter, a discharge gas is injected into the space.

Hereinafter, the process for sealing the upper and lower panels will be described in detail.

The sealing is performed by a screen printing method, a dispensing method, or the like.

In the screen printing method, a patterned screen is placed on a substrate with a predetermined space apart from the substrate, and a paste necessary for forming a sealing material is pressed and transcribed to print a desired shape of the sealing material. The screen printing method has advantages in that the production equipment is simple and the use efficiency of the material is high.

In the dispensing method, CAD wiring data used in the production of a screen mask is used, and a thick film paste is directly discharged onto the substrate using air pressure to form a sealing material. The dispensing method has advantages in that the mask production cost is reduced, and the shape of the thick film may be freely formed.

Figure 7A:
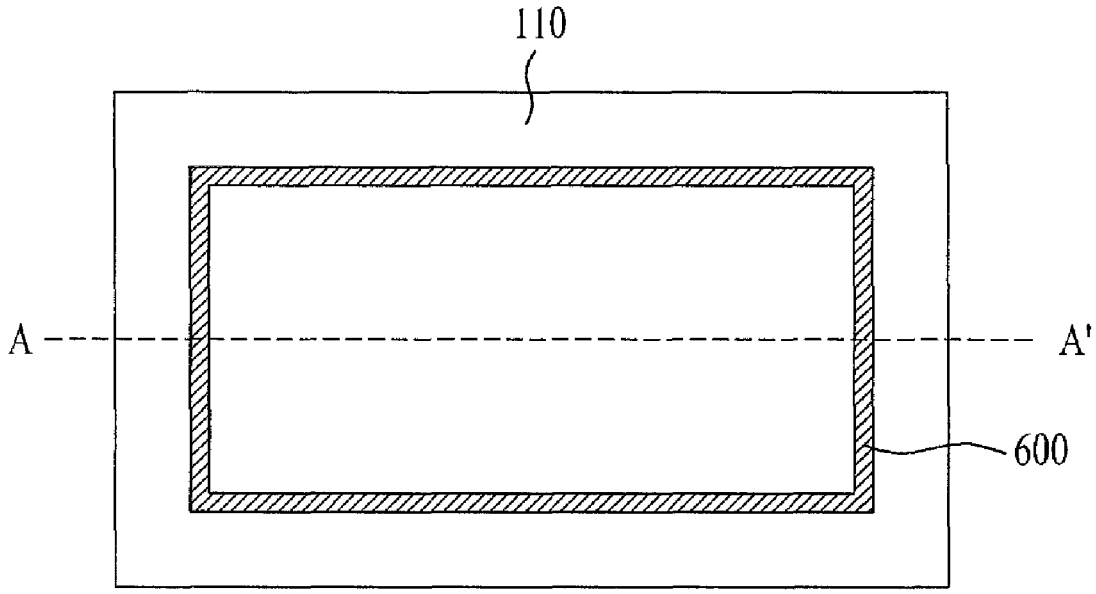
FIG. 7A is a view illustrating a process for assembling a front substrate and a back substrate of a plasma display panel.
Figure 7B:
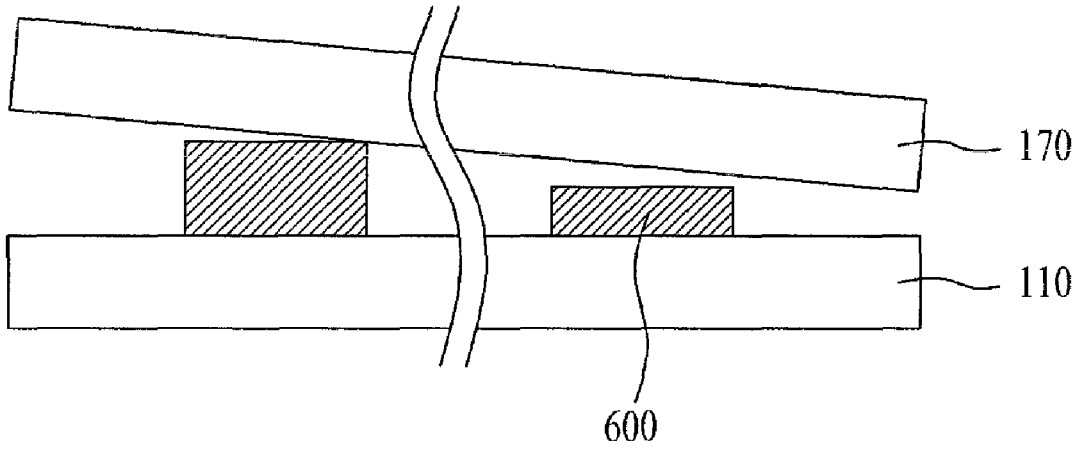
FIG. 7B is a sectional view along line A-A'.

FIG. 7A is a view illustrating a process for assembling a front substrate and a back substrate of a plasma display panel, and FIG. 7B is a sectional view along line A-A'.

As shown in FIGS. 7A and 7B, a sealing material 600 is coated over the front substrate 170 or the back substrate 110.

Specifically, the sealing material is printed or dispensed simultaneously with a predetermined space apart from the outermost of the substrate.

Thereafter, the sealing material 600 is cured. In the curing process, the organic materials included in the sealing material are removed, and the front substrate 170 and back substrate 110 are assembled.

In this curing process, the sealing material 600 may be widened and thickened.

The sealing material 600 in this embodiment is utilized by printing or coating, but the sealing material may be formed into a sealing tape and used by being adhered onto the front or back substrate.

Then, an aging process is carried out to enhance the characteristics as a passivation film, etc. at a predetermined temperature.

Subsequently, a front filter may be formed over the front substrate. In the front filter, an electromagnetic interference (EMI) shield film is provided to prevent EMI from emitting out from the panel.

The EMI shield film may be patterned into a specific shape using a conductive material to ensure the visible light transmittance required in the display device, while shielding EMI.

The front filter may further include a near infrared shield film, a color compensation film, and an anti-reflection film.

Accordingly, the present invention fabricated the barrier ribs by combining different pigments having complementary relation to each other resulting in preventing absorption of the visible light emitted inside the discharge cell, as well as reducing reflectance with respect to external light. Thus, an effect of largely reducing the brightness loss can be obtained.

It will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

What is claimed is:

1. A plasma display panel comprising:

a first substrate including a first electrode;

a second substrate arranged to face the first substrate, the second substrate including a second electrode; and barrier ribs arranged between the first substrate and the second substrate to define a discharge cell, the barrier ribs being colored with a mixture of at least two different pigments, wherein different barrier ribs have different mixing ratios of the at least two different pigments depending on their positions on the plasma display panel.

2. The plasma display panel according to claim 1, wherein the at least two different pigments are complementary colored pigments.

3. The plasma display panel according to claim 1, wherein the at least two pigments cause the barrier ribs to have an achromatic color.

4. The plasma display panel according to claim 1, wherein each pigment contained in the barrier ribs amounts to between approximately 0.1 to approximately 10 percent of a total weight of the barrier ribs.

5. The plasma display panel according to claim 1, wherein the barrier ribs comprise a mixture of a cobalt blue pigment and a brown pigment.

6. The plasma display panel according to claim 1, wherein all of the barrier ribs have the same mixing ratio of the at least two different pigments.

7. The plasma display panel according to claim 1, wherein the at least two pigments cause the barrier ribs to exhibit a reduced light reflectance within a specific wavelength band.

8. The plasma display panel according to claim 7, wherein the barrier ribs have a reduced light reflectance within a wavelength band corresponding to red colors.

9. The plasma display panel according to claim 1, further comprising a phosphor layer formed in the discharge cell, wherein the phosphor layer contains a pigment.

10. The plasma display panel according to claim 9, wherein the phosphor layer contains a pigment selected from the group consisting of an iron oxide pigment, a cobalt green pigment, an emerald green pigment, a chromium oxide green pigment, a chromium-alumina green pigment, a Victoria green pigment, a cobalt blue pigment, a Prussian pigment, a Turkey blue pigment, and a Co—Zn—Si pigment.

11. The plasma display panel according to claim 9, wherein each phosphor layer contains a pigment selected from the group consisting of $\alpha$-$Fe_2O_3$(Co,Zn)O.$(Al,Cr)_2O_3$, 3CaO—$Cr_2O_3$.$3SiO_2$, $(Al,Cr)_2O_3$, $CoOAl_2O_3$, 2(Co,Zn)O.$SiO_2$, and $ZrSiO_4$.

12. A plasma display panel comprising:

a first substrate;

a second substrate to face the first substrate; and a plurality of barrier ribs between the first substrate and the second substrate to define discharge cells, wherein different barrier ribs of the plurality of barrier ribs have different mixing ratios of at least two different pigments based on their respective positions on the plasma display panel.

13. The plasma display panel according to claim 12, wherein the at least two different pigments are complementary colored pigments.

14. The plasma display panel according to claim 12, wherein the at least two pigments cause the barrier ribs to have an achromatic color.

15. The plasma display panel according to claim 12, wherein each pigment contained in the barrier ribs is between approximately 0.1 to approximately 10 percent of a total weight of the barrier ribs.

16. The plasma display panel according to claim 12, wherein the barrier ribs comprise a mixture of a cobalt blue pigment and a brown pigment.

17. The plasma display panel according to claim 12, wherein all of the barrier ribs have the same mixing ratio of the at least two different pigments.

18. The plasma display panel according to claim 12, wherein the at least two pigments cause the barrier ribs to exhibit a reduced light reflectance within a specific wavelength band.

19. The plasma display panel according to claim 18, wherein the barrier ribs have a reduced light reflectance within a wavelength band corresponding to red colors.

20. The plasma display panel according to claim 12, further comprising a phosphor layer in the discharge cell, wherein the phosphor layer contains a pigment.

* * * * *